United States Patent [19]

Pezzoli

[11] Patent Number: 4,632,152

[45] Date of Patent: Dec. 30, 1986

[54] WEFT HOLDING MEMBER IN WEFT TRANSPORT GRIPPERS FOR WEAVING LOOMS

[75] Inventor: Nello Pezzoli, Leffe, Italy

[73] Assignee: VAMATEX S.p.A., Villa Di Serio, Italy

[21] Appl. No.: 844,259

[22] Filed: Mar. 24, 1986

Related U.S. Application Data

[63] Continuation of Ser. No. 658,802, Oct. 9, 1984, abandoned.

[30] Foreign Application Priority Data

Oct. 7, 1983 [IT] Italy ..... 23196 A/83

[51] Int. Cl.[4] ..... D03D 47/20

[52] U.S. Cl. ..... 139/448

[58] Field of Search ..... 139/447, 448

[56] References Cited

U.S. PATENT DOCUMENTS

| | | | |
|---|---|---|---|
| 4,129,155 | 12/1978 | Merisio | 139/448 |
| 4,357,964 | 11/1982 | Kohler | 139/448 |
| 4,418,727 | 12/1983 | Santucci | 139/448 |

FOREIGN PATENT DOCUMENTS

| | | | |
|---|---|---|---|
| 197806 | 6/1978 | Fed. Rep. of Germany | 139/448 |
| 1444834 | 3/1966 | France | 139/448 |
| 2142834 | 2/1973 | France | 139/448 |

*Primary Examiner*—Henry S. Jaudon

*Attorney, Agent, or Firm*—Young & Thompson

[57] ABSTRACT

A weft-carrying gripper for a weaving loom comprises a gripper body and a weft yarn holding member carried by the gripper body. The holding member oscillates relative to the gripper body toward and away from a weft yarn gripping portion of the body, alternately to grip and to release a weft yarn between a head on the holding member and the mentioned portion of the body. This oscillation can be either rectilinear movement of curvilinear movement. A flexible elastic element such as a spring metal lamina is carried by the head and is move toward and away from the yarn gripping portion of the body upon oscillation of the holding member. The elastic element, at the time it engages a weft yarn, bends about an axis transverse to the direction in which the head is moving at the time the elastic element engages the yarn.

1 Claim, 5 Drawing Figures

WEFT HOLDING MEMBER IN WEFT TRANSPORT GRIPPERS FOR WEAVING LOOMS

This application is a continuation of application Ser. No. 658,802, filed 10/9/84 now abandoned.

BACKGROUND OF THE INVENTION

As known, the reduction in size and mass of the grippers, which is sought especially to favour working speed in modern gripper weaving machines, complicates the gripping, holding and exchange operations on the part of said grippers.

On the other hand, the production requirements introduce new yarns, which are often difficult to work with as being of irregular count, or else they even provide for the insertion of two yarns at a time.

The grippers, as they are constructed at present, are not adapted to efficiently solve all the problems which the most recent requirements cause to constructors, and therefore often create considerable difficulties to the users.

SUMMARY OF THE INVENTION

The present invention proposes to give a concrete and satisfactory solution to such problems by supplying a weft holding member which, by guaranteeing a proper flexibility in the yarn gripping area, allows on the one hand the yarn insertion even in the most unfavourable conditions (voltage drops, count irregularities, and the like), permitting at the same time proportioning the resilient gripping members on the basis of the requirements imposed by the most recent technical developments, leaving moreover free space for cleaning the contact and gripping area.

For these purposes, the present invention supplies a weft holding member of the type with a stiff arm, oscillating under the action of a spring, characterized in that the element for engaging the weft yarn and pressing the same against the gripper body with which the weft holding member is associated, consists of a flexible metal lamina.

Said lamina preferably comprises two or more pressure extensions, allowing holding the weft yarn at several points.

Also according to the invention, a second—identical or different—lamina can be associated with said flexible metal lamina, in order to obtain a different flexibility.

BRIEF DESCRIPTION OF THE DRAWINGS

The invention will now be described in further detail, with reference to the accompanying drawings, which illustrate some preferred embodiments of the weft holding member according to the invention, and in which.

DESCRIPTION OF THE PREFERRED EMBODIMENTS

Figure 1:
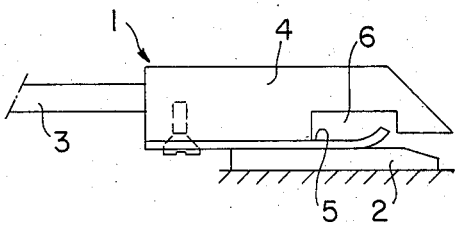
FIGS. 1 and 2 show a diagrammatic view of a first type of carrying gripper using the weft holding member according to the invention, in an operative and, respectively, inoperative position.
Figure 2:
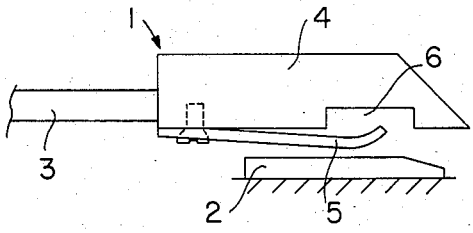

With reference to the drawings (FIGS. 1 and 2), a carrying gripper of the type according to U.S. Pat. No. 4,505,305—wherein the weft yarn holding member 1 engages the gripper body 2 for rotation around a pin 3 oscillating about an axis longitudinal to the gripper—is modified, according to the invention, by using in the lower part of the head 4 of said holding member 1 a flexible metal lamina 5, a cavity 6 being created in the head 4 for housing the free arched end of said lamina 5.

As seen, the flexible lamina 5 is the element of the holding member 1 which, according to the invention, engages the gripper body 2.

Figure 3:
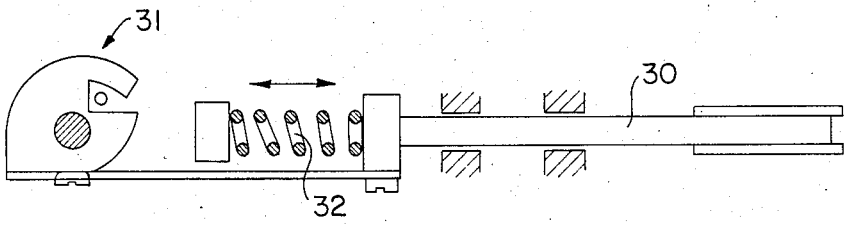
FIGS. 3 to 5 show diagrammatic views of a second type of drawing gripper, using the weft holding member according to the invention, in the operative and inoperative positions.
Figure 4:
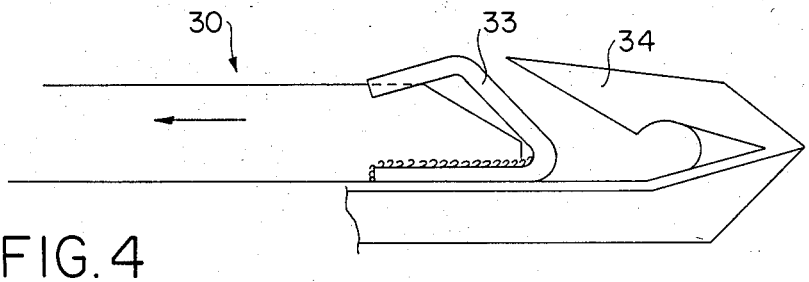
Figure 5:
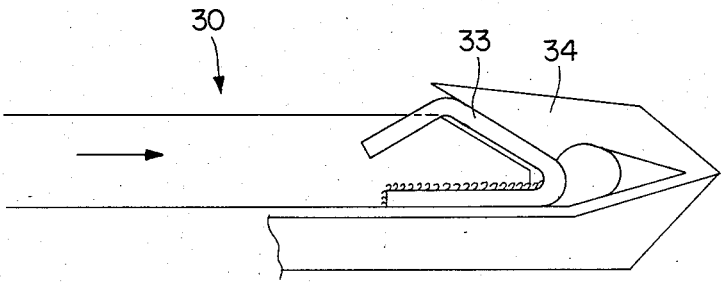

The drawing gripper of FIGS. 3 to 5 is of the type with the weft holding member 30 sliding longitudinally of the gripper itself and controlled by advancement means 31 (plan view of FIG. 3) and by a return spring 32. According to the invention, a flexible metal lamina 33, of arched shape, forms the element of the holding member 30 for weft engagement. As shown in the drawing, said lamina is designed to contact inside the hook 34 of the gripper, to lock the weft yarn therein. As will be evident from FIGS. 4 and 5, the lamina 33 is integral with the forward end of the head of holding member 30 and extends rearwardly in spaced relation to the head in a direction diagonal to the direction of rectilinear reciprocation of the holding member 30 and terminates rearwardly in a free end. As is evident from FIG. 5, the lamina has an operative position in which a substantial length of the lamina resiliently contacts the hook when the weft yarn holding member is fully seated in the hook and in which that length of lamina on the side opposite the hook is spaced from holding member 30.

In the figures of the accompanying drawings, the lamina is applied by screwing, but other means of application may be used, especially welding.

It is understood that, owing to the particular flexibility given, according to the invention, to the weft engagement element (the lamina according to the invention is deemed to guarantee a flexibility which is almost twice that of the most flexible weft holding members now used on grippers of weaving looms), the heretofore described and illustrated weft holding member provides a smooth but firm and reliable engagement with any type of yarn and under any possible operating conditions.

I claim:

1. In a weft carrying gripper for a weaving loom comprising a gripper body and a weft yarn holding member carried by the gripper body and rectilinearly reciprocable relative to the gripper body toward and away from a weft yarn gripping hook of said body alternately to grip and release a weft yarn between a head on said holding member and said hook of said body; the improvement in which said head includes a resilient metal lamina movable toward and away from said hook upon oscillation of said holding member, said lamina being integral with the forward end of the head and extending rearwardly in spaced relation to the head in a direction diagonal to the direction of rectilinear reciprocation of the holding member and terminating rearwardly in a free end, said lamina, upon engaging a weft yarn, bending about an axis transverse to the direction in which said head is moving at the time the lamina engages a weft yarn, said lamina having an operative position in which a substantial length of said lamina resiliently contacts the hook when said weft yarn holding member is fully seated in the hook and in which said length of lamina on the side opposite the hook is spaced from said holding member.

* * * * *